US009476421B2

(12) United States Patent
Cesak et al.

(10) Patent No.: US 9,476,421 B2
(45) Date of Patent: Oct. 25, 2016

(54) CYLINDER HEAD FOR A TWO-STAGE RECIPROCATING PISTON COMPRESSOR

(71) Applicants: Roland Cesak, Schwabbruck (DE); Bernhard Spiegl, Vienna (AT); Andreas Brandl, Vienna (AT)

(72) Inventors: Roland Cesak, Schwabbruck (DE); Bernhard Spiegl, Vienna (AT); Andreas Brandl, Vienna (AT)

(73) Assignee: Hoerbiger Kompressortechnik Holding GmbH, Vienna (AT)

( * ) Notice: Subject to any disclaimer, the term of this patent is extended or adjusted under 35 U.S.C. 154(b) by 345 days.

(21) Appl. No.: 14/162,182

(22) Filed: Jan. 23, 2014

(65) Prior Publication Data

US 2014/0208938 A1 Jul. 31, 2014

(30) Foreign Application Priority Data

Jan. 25, 2013 (AT) ..... 50056/2013

(51) Int. Cl.

| | |
|---|---|
| ***F04B 53/00*** | (2006.01) |
| ***F04B 39/06*** | (2006.01) |
| ***F04B 39/12*** | (2006.01) |
| ***F04B 53/08*** | (2006.01) |

(52) U.S. Cl.

CPC ..... *F04B 53/007* (2013.01); *F04B 39/06* (2013.01); *F04B 39/064* (2013.01); *F04B 39/125* (2013.01); *F04B 53/08* (2013.01)

(58) Field of Classification Search

CPC ..... F04B 53/007; F04B 53/08; F04B 39/06; F04B 39/064; F04B 39/125

See application file for complete search history.

(56) References Cited

FOREIGN PATENT DOCUMENTS

| | | |
|---|---|---|
| DE | 102005012202 | 9/2006 |
| GB | 2044365 | 10/1980 |

OTHER PUBLICATIONS

English Abstract of DE102005012202.

*Primary Examiner* — Nathaniel Wiehe
*Assistant Examiner* — Logan Kraft
(74) *Attorney, Agent, or Firm* — Dykema Gossett PLLC

(57) ABSTRACT

A cylinder head for a two-stage reciprocating piston compressor includes an intercooler that is designed as a cooled overflow channel between the pressure side of the first stage and the suction side of the second stage, wherein the overflow channel has a substantially slot-like cross-section, and the overflow channel is in addition divided by at least one indirectly cooled center rib so that therefrom at least two overflow channel portions and are created. The cylinder head has a cylinder head upper part and a cylinder head lower part, the cross-section of the indirectly cooled center rib is divided in its longitudinal extent thereby forming a passage gap between the overflow channels and that run on both sides, and one portion of the center rib is formed from the cylinder head upper part and the other portion of the center rib is formed from the cylinder head lower part.

10 Claims, 2 Drawing Sheets

CYLINDER HEAD FOR A TWO-STAGE RECIPROCATING PISTON COMPRESSOR

BACKGROUND OF THE INVENTION

Figure 2:
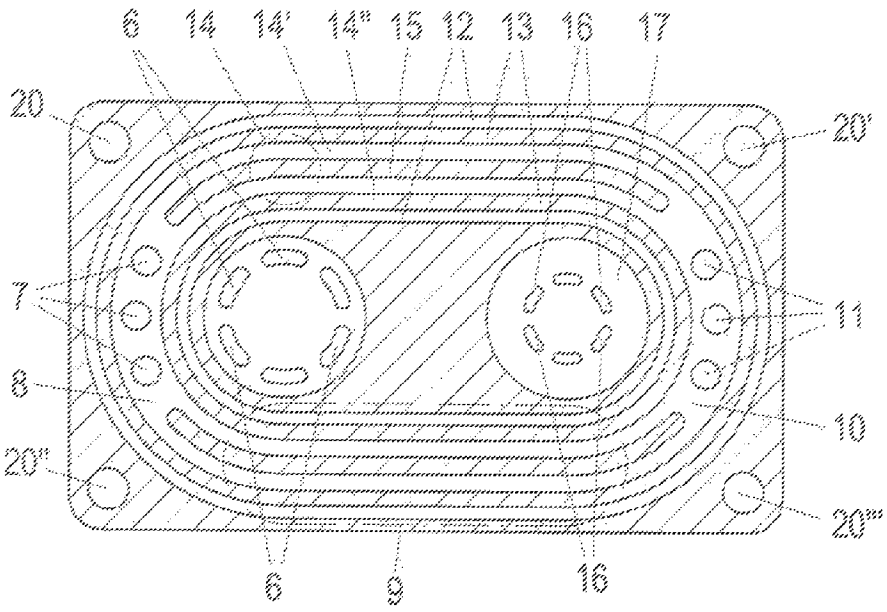

The invention relates to a cylinder head for a two-stage reciprocating piston compressor which includes an intercooler that is designed as a cooled overflow channel between the pressure side of the first stage and the suction side of the second stage, wherein the overflow channel has a substantially slot-like cross-section, and wherein the overflow channel is in addition divided by at least one indirectly cooled center rib so that therefrom at least two overflow channel portions are created.

Today, commercial vehicles such as, for example, trucks, busses, construction machines and rail vehicles, have in most cases brakes which are actuated with the support of compressed air, and for the compressed-air supply usually a compressor is provided which is driven by the internal combustion engine that serves for driving the vehicle. Such a compressor often also supplies compressed air to further sub-systems of the vehicle such as, for example, the pneumatic suspension. The cylinder head of this compressor comprises the suction and pressure valves including the associated feed and discharge channels, and is today in most cases integrated at least in the cooling circuit of the internal combustion engine, so that even if the compressor runs at a high speed level for a longer period of time, or if high compressor capacity is required for a longer period of time, the temperature level of the compressor can be kept adequately low. Thus, temperature problems mainly occur in the pressurized gas which, in the case of two-stage reciprocating piston compressors, should preferably be cooled not only at the outlet of the reciprocating piston compressor, but should already be cooled without any losses prior to entering into the second compressor stage so that the occurring maximum temperatures of the gas do not exceed a given value. Furthermore, an inlet gas temperature that is lower with regard to the second compressor stage results in an increased compressor capacity.

The suctioned ambient air is usually guided via the suction tube of the first stage into the suction chamber thereof. After a working stroke of the piston of the first stage, the air arrives as pressurized gas via the pressure valve in the pressure chamber of the first stage. Via an intercooler designed as a cooled overflow channel between the pressure side of the first stage and the suction side of the second stage, the pressurized gas is fed into the suction chamber of the second stage and, after this double compression, exits the reciprocating piston compressor. Such intercoolers in different embodiments have been known for a long time, wherein, however, mostly separately cooled wall elements or the like are used.

From DE 10 2005 012 202 A1, a cylinder head of the aforementioned type is known in which the pressure chamber of the first stage and the suction chamber of the second stage are combined so as to form a intermediate chamber with water-cooled ribs. In the preferred embodiment, these water-cooled ribs are implemented as cast parts. Another configuration provides the use of a formed sheet metal part that forms the water-cooled ribs. Both variants provide that each of the ribs is water-cooled. Since the cooling-water-carrying cross-section of the ribs cannot be reduced at will in order to avoid a stalling flow and increased friction in the cooling water, there is only a greatly reduced volume available for the compressed air to be cooled, due to the limited constructed space in the cylinder head. Thus, for this reason, the heat transfer from the pressurized gas into the cylinder cooling system of the known embodiment cannot be optimized further.

DE 2905720 A1 shows a cylinder head for at least two-stage compressors, in which cylinder head the flow channel between the pressure side of the first stage and the suction side of the second stage is configured as an intercooler in such a manner that said overflow channel is surrounded by a coolant chamber. As a further measure for dissipating head, ribs are provided which protrude into the low-pressure chamber and through which no coolant flows. Since the additional ribs are arranged directly above the pressure valve of the first stage, a further increase in cooling capacity, for example by elongating the ribs or increasing the cooling surface in a different way, is not possible.

It is an object of the present invention to design a cylinder head of the aforementioned type in such a manner that the mentioned disadvantages of the known embodiment are avoided, and that in particular the cooling effect on the pressurized gas between the two stages can be improved while maintaining a simple production possibility.

SUMMARY OF THE INVENTION

This object is achieved according to the present invention in that the cylinder head has a cylinder head upper part and a cylinder head lower part, that the cross-section of the indirectly cooled center rib is divided in its longitudinal extent thereby forming a passage gap between the overflow channels that run on both sides, and that one portion of the center rib is formed from the cylinder head upper part and the other portion of the center rib is formed from the cylinder head lower part.

In addition to a further increase of the surface on which a heat exchange can take place, this results in saving a contact surface/sealing surface and therefore in a reduction of manufacturing complexity and associated costs. At a base width that corresponds to less than a third of the base width of a conventional water-cooled rib, the indirectly cooled center rib has no disadvantages whatsoever with regard to the dissipated heat, and, with regard to production and operational control (no additional supply of cooling medium required), has advantages over the prior art that are readily apparent to the person skilled in the art. This is enabled by the simple optimization of the cross-sectional ratios, without additional space requirements and manufacturing complexity, for example, for preparing further channels that carry cooling medium, while drastically increasing the surface on which the heat transfer for cooling the pressurized gas on take place.

A refinement of the invention provides that there are a plurality of overflow channels in the cylinder head, which are each divided by at least one uncooled center rib, whereby the heat dissipation is further improved. Furthermore, both the base width of the center rib and the width of the resulting slot-like channels can vary in the longitudinal direction.

Another configuration of the invention provides that the center rib has a cross-section that is at least approximately rectangular or trapezoidal. This enables producing the center rib by means of a variety of different manufacturing methods, including both cutting and non-cutting methods.

According to another refinement of the invention, the overflow channels run from the pressure chamber of the first stage to the suction chamber of the second stage, wherein the sum of the volumes from the pressure chamber of the first stage, the intercooler, and the suction chamber of the second stage is greater than the volume of the first stage, which volume is expelled during a compression cycle. This has the consequence that the gas remains in the intercooler for a longer period of time and therefore gives off as much as possible of the heat generated in the course of the compression.

The present invention is explained in more detail below with reference to the FIGS. 1 to 5, which show an advantageous configuration of the invention in an exemplary, schematic and non-limiting manner.

Figure 1:
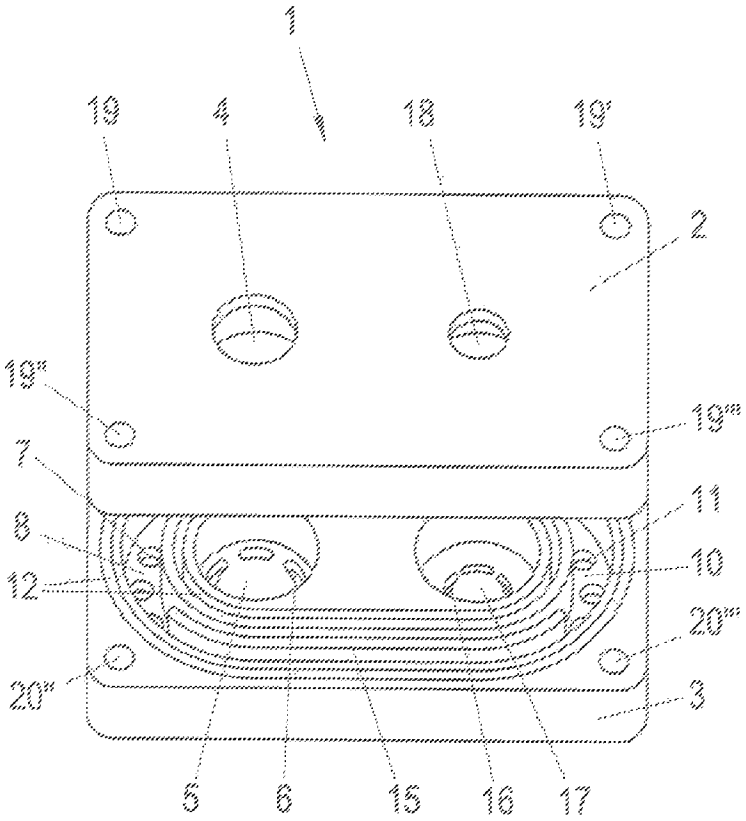
Figure 4:
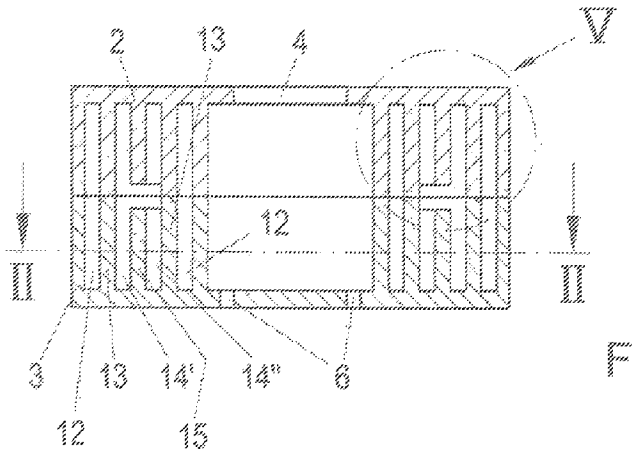
Figure 5:
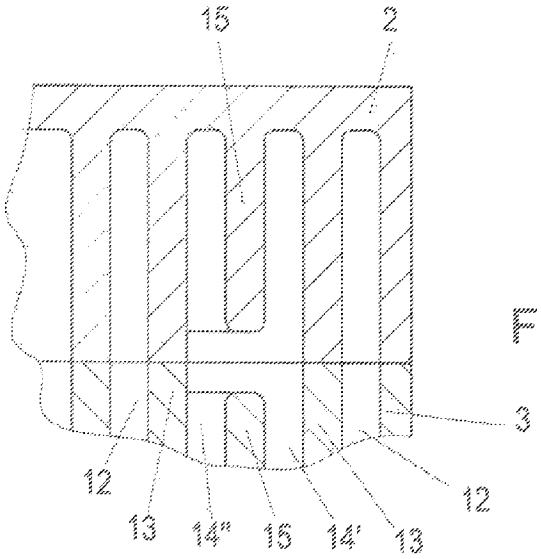
Figure 3:
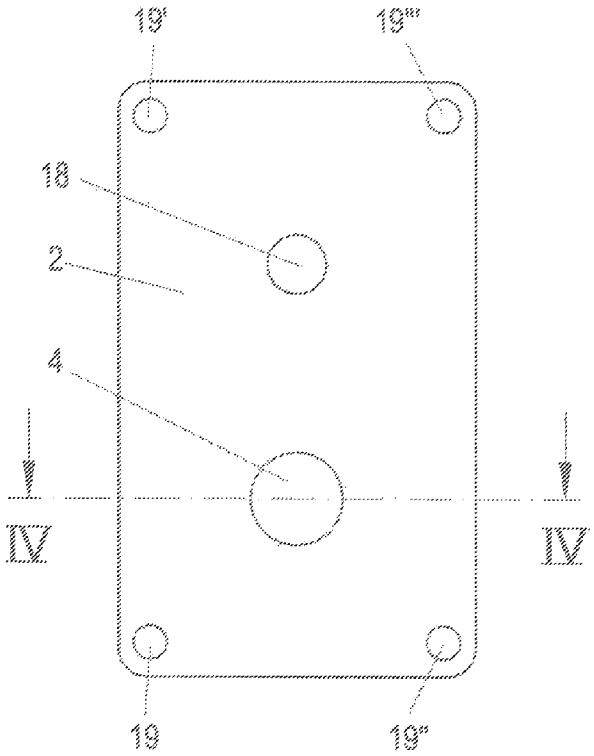

FIG. 1 shows the upper and lower parts of the cylinder head in a perspective view from above (thus in the direction of the cylinders of the non-illustrated reciprocating piston compressor, which cylinders are to be imagined to be located underneath the cylinder head), FIG. 2 shows a horizontal section through the lower part of the cylinder head along the line II-II in FIG. 4, FIG. 3 shows the top view onto the upper part of the cylinder head, FIG. 4 shows a section along the line IV-IV in FIG. 3, and FIG. 5 shows the detail V in FIG. 4,

DETAILED DESCRIPTION OF THE DEPICTED EMBODIMENTS

The shown cylinder head 1 consists substantially of a cylinder head upper part 2 and a cylinder head lower part 3. In the cylinder head upper part 2 there is a suction opening 4 and a pressure opening 18. Due to the downward movement of a non-illustrated piston of the reciprocating piston compressor, the gas to be compressed is suctioned via the suction chamber 5 into the cylinder of the first stage, wherein the non-illustrated suction valve below the suction valve openings 6 is open.

Due to the upward movement of the mentioned piston, the suction valve is closed and the pressurized gas flows through the open pressure valve and the pressure valve openings 7 thereof into the pressure chamber 8 of the first stage.

Due to the upward movement of the first piston, the expelling resulting therefrom, and the simultaneous downward movement of the second piston and the resulting suctioning, the pressurized gas is fed through the intercooler 9 into the suction chamber 10 of the second stage and via the open suction valve and the suction valve opening 11 thereof into the second cylinder of the reciprocating piston compressor.

In the course of the upward movement of the second piston of the reciprocating piston compressor, the suction valve of the second stage is closed, the pressure valve of the second stage is opened, and the pressurized gas is expelled via the pressure valve openings 16 into the pressure chamber 17 of the second stage. The double-compressed pressurized gas exits the reciprocating piston compressor via the pressure opening 18 in the cylinder head upper part 2.

As shown in FIG. 4 and FIG. 5, the intercooler 9 consists of ribs 13 which are directly cooled via water channels 12 and form the overflow channel 14 which is additionally divided by an indirectly cooled center rib 15 so that therefrom at least two overflow channels 14' and 14" are created, the cross-section of which in one dimension is substantially smaller than transverse thereto, wherein it is also possible that there are a plurality of overflow channels 14, which are each divided by at least one uncooled center rib 15.

The water channels 12, the directly cooled ribs 13, and the indirectly cooled center rib 15 are formed both in the cylinder head upper part 2 and the cylinder head lower part 3. Apart from that, one of the two cylinder head parts 2 or 3 can also be combined with a smooth cover in which no channels are formed.

Furthermore, it is shown in FIG. 5 and also in FIG. 4 that the cross-section of the indirectly cooled center rib 15 is divided in its longitudinal direction thereby forming a passage gap between the overflow channel portions 14' and 14" that run on both sides, which results in the already mentioned advantages. It should be noted that, besides an at least approximately rectangular cross-section, as illustrated in FIG. 4 and FIG. 5, the indirectly cooled center rib 15 can also have a trapezoidal cross-section.

The mounting holes 19-19"" and 20-20"" shown in FIG. 1, FIG. 2 and FIG. 3 are provided for fixing the cylinder head 1 on a cylinder of a non-illustrated reciprocating piston compressor, which cylinder is to be imagined to be located underneath the cylinder head.

Apart from the specific embodiment for a two-stage reciprocating piston compressor, an intercooler configured in such a manner could, of course, also be used for three-stage or multi-stage reciprocating piston compressors.

The invention claimed is:

1. A cylinder head for positioning on top of a two-stage reciprocating cylinder compressor, said cylinder head comprising:

separate upper and lower head parts which, when positioned in contact, define a first suction chamber for supplying air to a first stage of the reciprocating compressor, a first pressure chamber for receiving pressurized air from the first stage, a second suction chamber for receiving pressurized air from the first pressure chamber and supplying the pressurized air to a second stage of the reciprocating compressor, and a second pressure chamber for receiving further pressurized air from the second stage, each of said upper and lower head parts including first pairs of vertical channel ribs which, when said upper and lower parts are positioned in contact and the cylinder head is positioned on top of the reciprocating compressor, extend vertically and define an intercooler overflow channel which extends longitudinally between the first pressure chamber and the second suction chamber, as well as center divider ribs which extend vertically into and along said intercooler overflow channel to define overflow channel portions on opposite sides thereof, the divider ribs not contacting so as to define a longitudinally-extending passage gap there between.

2. The cylinder head according to claim 1, wherein said vertical channel ribs define a plurality of overflow channels which are each divided by a center rib.

3. The cylinder head according to claim 1, wherein both a base width of the center rib and a width of the overflow channel portions vary in the longitudinal direction.

4. The cylinder head according to claim 1, wherein the center rib has a cross-section that is approximately rectangular or trapezoidal.

5. The cylinder head according to claim 1, wherein said upper head part provides a suction opening communicating with said first suction chamber, and said lower head part provides suction valve openings for communicating said first suction chamber with the first stage of the reciprocating compressor.

6. The cylinder head according to claim 5, wherein said lower head part provides first pressure valve openings for communicating the first stage of the reciprocating compressor with said first pressure chamber.

7. The cylinder head according to claim 6, wherein said lower head part provides second suction valve openings for communicating said second suction chamber with the second stage of the reciprocating compressor.

8. The cylinder head according to claim 7, wherein said lower head part provides second pressure valve openings for communicating the second stage of the reciprocating compressor with said second pressure chamber.

9. The cylinder head according to claim 8, wherein said upper head part provides a pressure opening communicating with said second pressure chamber.

10. The cylinder head according to claim 1, including second pairs of vertical ribs forming, respective cooling water channels along respective outer sides of said vertical ribs which form said intercooler overflow channel.

* * * * *